United States Patent [19]

Wada

[11] 4,216,628

[45] Aug. 12, 1980

[54] DEVICE FOR AUTOMATICALLY GRINDING SYRINGE NEEDLE POINT

[76] Inventor: Shoji Wada, 11-22, Katase Kaigan 2-chome, Fujisawa-shi, Kanagawa-ken, Japan

[21] Appl. No.: 947,503

[22] Filed: Oct. 2, 1978

[30] Foreign Application Priority Data

Oct. 21, 1977 [JP] Japan ..... 52/125789

[51] Int. Cl.[2] ..... B24B 19/16

[52] U.S. Cl. ..... 51/98.5; 51/165.77; 51/227 H

[58] Field of Search ..... 51/227, 227 H, 165.77, 51/165.87, 165.88, 165 R, 98.5

[56] References Cited

U.S. PATENT DOCUMENTS 3,641,713 2/1972 Humes ..... 51/165.88

3,975,864 8/1976 Glowacki ..... 51/165.87

4,173,100 11/1979 MacBroom ..... 51/227 H

*Primary Examiner*—Harold D. Whitehead

*Attorney, Agent, or Firm*—Wenderoth, Lind & Ponack

[57] ABSTRACT

An automatic grinder for grinding a syringe needle point includes a holder for holding a tube to be ground, a grinder, a hold-angle changer to change the angle at which the tube is held, a device to change the angular alignment of the tube by rotating the tube about its axis, a grinding volume changer to change the spacing between the holder and the grinder, a reciprocator to reciprocate the tube holder relative to the grinder for carrying out a grinding operation, a space adjuster to compensate for wear of the grinding surface in the grinder, and a grinding controller for automatic coordination of these units according to a preset program.

17 Claims, 18 Drawing Figures

DEVICE FOR AUTOMATICALLY GRINDING SYRINGE NEEDLE POINT

BACKGROUND OF THE INVENTION

Conventionally the grinding of a syringe needle point is done by traversing a plurality of tubes which are joined and aligned by a tape along the grinding surface of a grinder with the ground plane of the tubes matching the plane of the grinding surface of the grinder.

Grinding takes place in a plurality of steps with the longitudinal angle of the tube to the grinding plane and the angular alignment of the tube about its axis being varied, whereby a syringe needle point with a main bevel and a side bevel can be produced.

In such a formation of the syringe needle point, as stated above a plurality of tubes are simultaneously ground. Therefore, the tube holder must extend in a horizontal direction, the holding pressure on all tubes must be uniform, the tips of the tubes being ground must be only minimally deflected so that slack will not occur even after a long period of service, and the angular alignment of each tube about its axis must be changed smoothly, reliably and uniformly.

For the sake of producing a syringe needle of high quality by exact grinding, the angle of the tube to the grinding plane and the angular alignment of the tube about its axis must be precisely changed.

When the grinding surface of the grinder becomes worn due to repeated use of the machine, the space between the grinding surface of the grinder and the ground plane of the tube must be adjusted to compensate for wear so that such space can always be maintained constant.

To the best knowledge of the inventor, there is no grinder for grinding a syringe needle point which fully meets all of these requirements.

The conventional tube holder holds the tube with difficulty, and the position of the held tube is not always satisfactory, thus calling for fine adjustment by a skilled worker.

Also a high degree of manual skill is needed for smooth, reliable and uniform rotation of the tube to change the angular alignment of the tube about its axis to carry out side bevel grinding.

As for the wear of the grinding surface of the grinder, a syringe needle point which has been ground at an empirically presumed timing of the grinding surface is inspected. If it is determined that a shortage of grinding of the tube is developing or has developed, the degree of shortage is checked by a micrometer or a magnifying glass, and the grinding surface of the grinder is moved closer to the tube by a distance corresponding to the amount of wear, and a corrective grinding operation is performed.

The corrective grinding operation also calls for a high degree of manual skill, and even such high skill cannot cope with a fine degree of wear of the grinding surface. Thus, the result of grinding becomes poor with wide variations in the grinding volume depending on the amount of correction, and syringe needles with irregular dimensions are produced. In the case of mass production, it is difficult to obtain products of uniform quality.

For these reasons, in conventional syringe needle point grinding operations a skilled worker has to continuously monitor the condition of the tube held in the tube holder, the angular alignment of the tube about its axis, and the condition of wear of the grinding surface of the grinder. Accordingly, full automation of the grinding operation has been deemed impracticable.

SUMMARY OF THE INVENTION

According to the present invention, all the above obstacles to the full automation of the grinding operation are eliminated and the syringe needle point is fully automatically ground.

The primary object of the present invention is to provide an automatic grinder for grinding a syringe needle point automatically without the need for skilled labor during the grinding operation.

Another object of the present invention is to provide such an automatic grinder which includes a tube holder which assures accurate holding of a tube with no need for special adjustment by a skilled worker.

Still another object of the present invention is to provide such an automatic grinder which assures a smooth, reliable, uniform and automatic rotation of the tube about its axis to change the angular alignment of the tube for side bevel grinding, without the need for manual skill.

Still another object of the present invention is to provide such an automatic grinder which assures an automatic correction of the grinder position to compensate for wear of the grinding surface of the grinder without the need for skilled labor.

Still another object of the present invention is to provide such an automatic grinder which can compensate for even minor wear of the grinding surface, thereby assuring products of uniform quality.

BRIEF DESCRIPTION OF THE DRAWINGS

The automatic grinder according to the present invention will be more exactly understood from the following detailed description of the invention with reference to the attached drawings which are illustrative and exemplary only and which do not limit the scope of the invention, and wherein.

DETAILED DESCRIPTION OF THE INVENTION

Referring to the attached drawings, an embodiment of the present invention will now be described. In the Figures, like symbols denote like parts.

Figure 1:
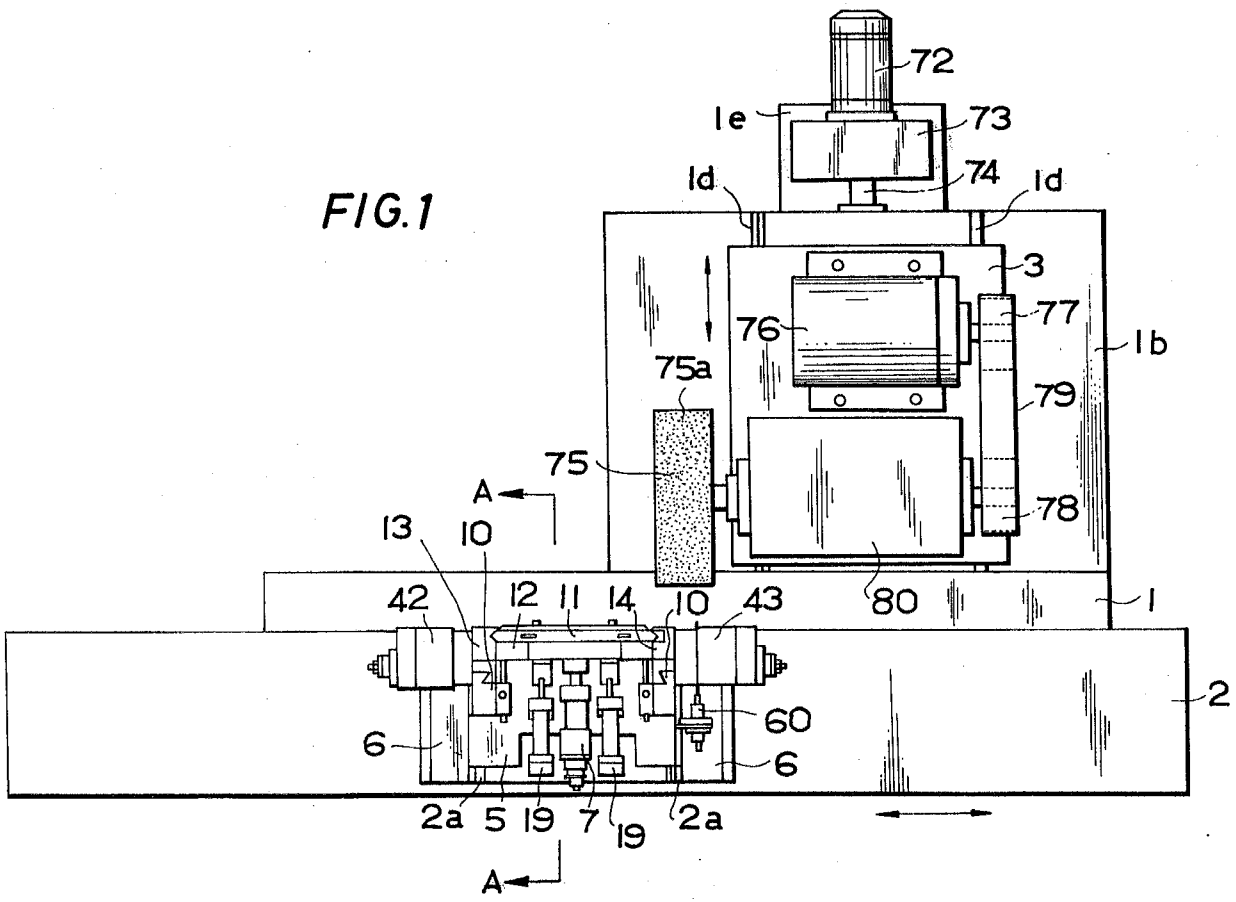
FIG. 1 is a plan view of the grinder of the invention.
Figure 2:
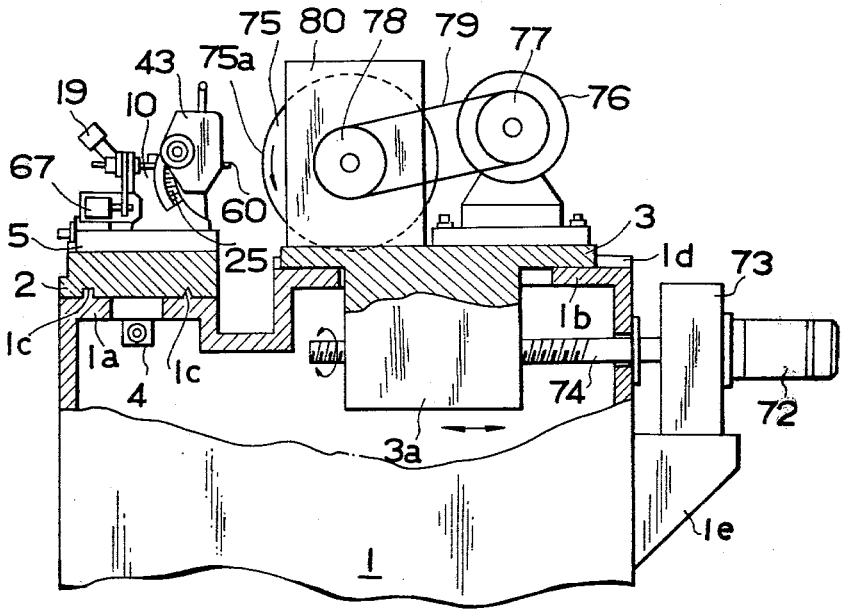
FIG. 2 is a side view, partially in section, of a portion of the grinder.

With reference to FIGS. 1 to 6, and as particularly clearly illustrated in FIG. 2, a table bed 1*a* and a saddle bed 1*b* are integrated to form a mount 1. A grinder table 2 is positioned on the table bed 1*a*, and a saddle 3 is positioned on the saddle bed 1*b*.

The underside of grinder table 2 has therein grooves matching ribs 1*c* formed on the top side of the table bed 1*a*, such that the grinder table 2 is free to slide on the table bed 1*a* in the longitudinal direction. An oil-pressure cylinder 4 is connected to both grinder table 2 and the undersurface of the table bed 1*a*, such that the grinder table 2 may be, as described below, reciprocated over the table bed 1*a* by the oil-pressure cylinder 4.

On both ends of the table bed 1*a* there are provided limit switches, not shown in the drawings, which detect and act when the grinder table 2 reaches the end of the table bed 1*a*. The action of these limit switches stops operation of oil-pressure cylinder 4. A slide base 5 is positioned at the top center of the grinder table 2, shown most clearly in FIGS. 4 and 5.

Ribs 2*a* are formed in the top surface of the center portion of the grinder table 2. Ribs 2*a* are formed to extend in a direction orthogonal to the direction of movement of the grinder table 2 on the table bed 1*a*. That is, ribs 2*a* extend toward the saddle 3. Grooves which match ribs 2*a* are formed in the underside of the slide base 5, such that the slide base 5 is slidable in the direction of ribs 2*a* on the grinder table 2. Guide pieces 6 are attached to grinder table 2 on opposite sides of the slide base 5, such that slide base 5 slidably contacts and is guided by guide pieces 6. The slide base 5 is driven for displacement between forward and backward positions thereof by oil-pressure cylinder 7 which is fixed to the top of the grinder table 2. Oil-pressure cylinder 7 is equipped with a fine stroke adjusting mechanism 9 which has a dial plate 8 and which controls the forward and backward displacements of the slide base 5. Such forward and backward displacements of slide base 5 determine the amount of side bevel grinding, indicated by y in FIG. 16(D).

Fine stroke adjusting mechanism 9 includes contact members provided at the rear of the cylinder body and at the rear of the piston rod of the oil-pressure cylinder 7, whereby movement of the piston rod is stopped when the contact member of the piston rod contacts the contact member of the cylinder body as the piston rod moves forward. The contact member of the piston rod is adjustably screwed into the outside of the piston rod, so that rotation of such contact member will adjust the relative position thereof, and the allowed amount of displacement of the piston rod, in the axial direction of the piston rod. The dial plate 8 turns together with the contact member of the piston rod to give a calibrated reading of the length of the stroke.

As shown in FIGS. 1 and 3 to 5, on the slide base 5 there are positioned a pair of angular table guides 10 which support a tube element or tube holder 11 through an angular table or support 12, tube element or tube holder guides 13 and 14 and a block 15.

Figure 6:
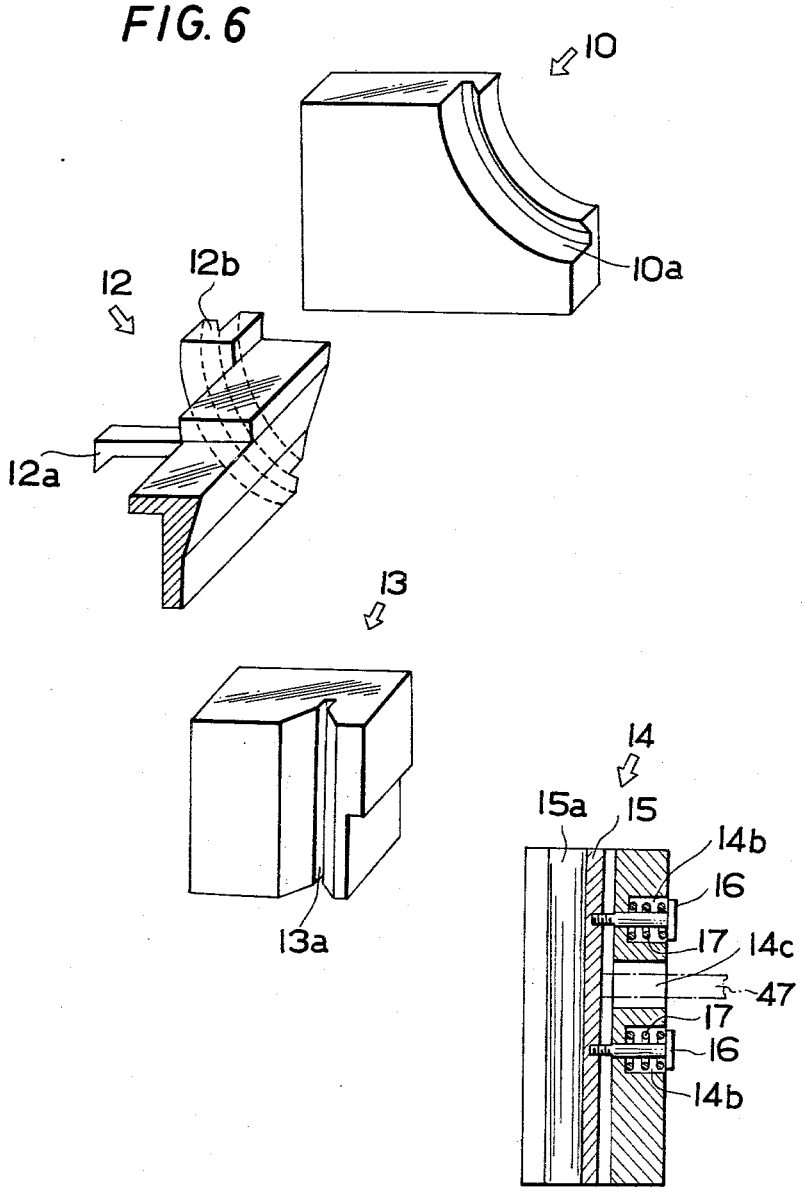
FIG. 6 shows perspective views of the angular table, the angular table guide and one of the tube holder guides, and a vertical section view showing the other of the tube holder guides.

As shown in FIG. 6, the angular table guides 10 are plates, each of which has in one corner thereof an arc-shaped notch. The table guides extend toward and parallel to the direction of the saddle 3. The inner portion of the surface of the notch of each angular table guide 10 has formed therein an arc-shaped guide groove 10*a*. Thus, each guide groove 10*a* is formed in an arc which extends in a vertical plane parallel to the direction of movement of the slide base 5, i.e. in a vertical plane extending in the direction of the saddle 3.

The angular table 12 is positioned between the angular table guides 10. As illustrated in FIG. 6, opposite ends or sides of the angular table 12 are provided with arc-shaped guide pieces 12*b* which slidably fit within respective angular table guides 10. The angle of the angular table 12 can be changed by causing the guide pieces 12*b* to slide along respective of the guide grooves 10*a*. The angular table 12 is approximately T-shaped in section, and the mid-portion of the top surface of the angular table is lower than the opposite end portions thereof.

The arc center of the guide grooves 10*a* on the angular table guides 10 constitutes the grinding position for the tip of a tube element or tube 18 to be ground. Thus, as indicated in FIG. 3, the tube element 18 is held in the tube element holder 11 with the tip of the tube element 18 positioned at the arc center.

Figure 3:
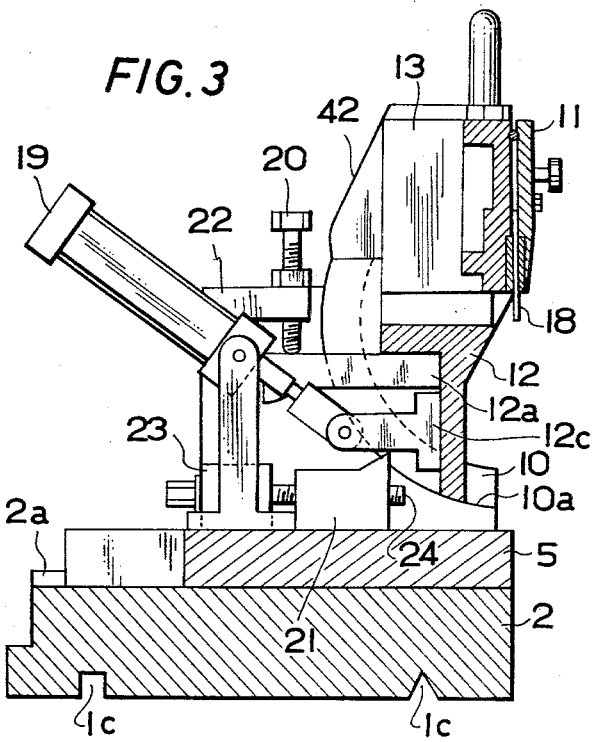
FIG. 3 is a section of the grinder table taken along line A—A in FIG. 1.
Figure 4:
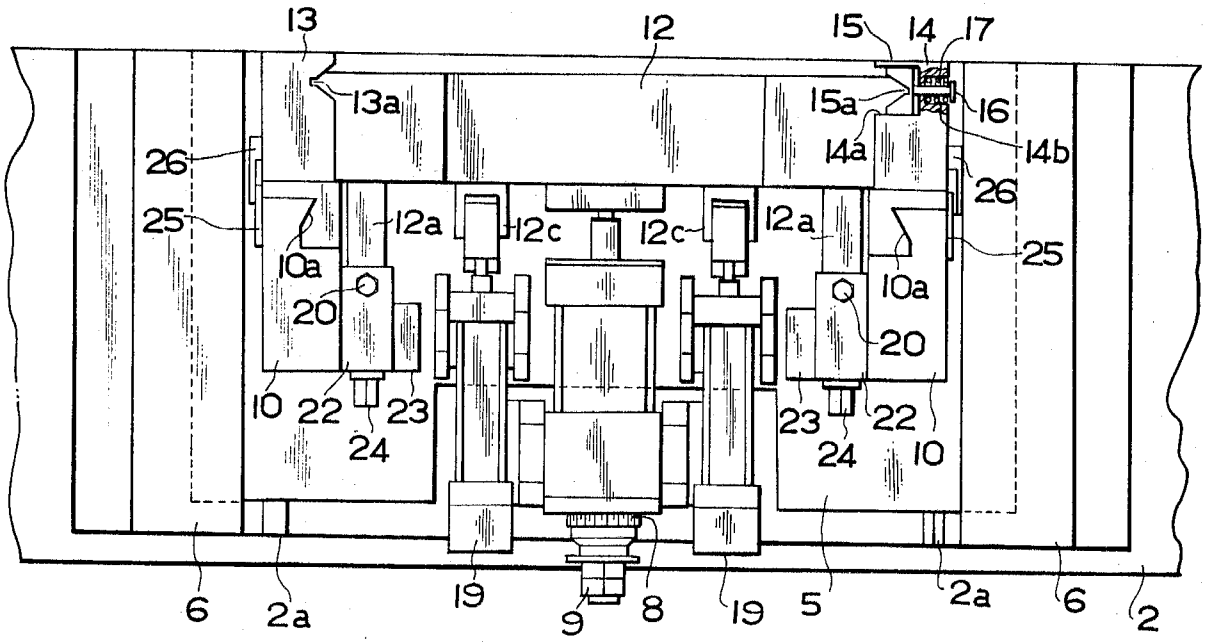
FIG. 4 and FIG. 5 are respectively a plane view and a backside view partially showing the grinder table.
Figure 5:
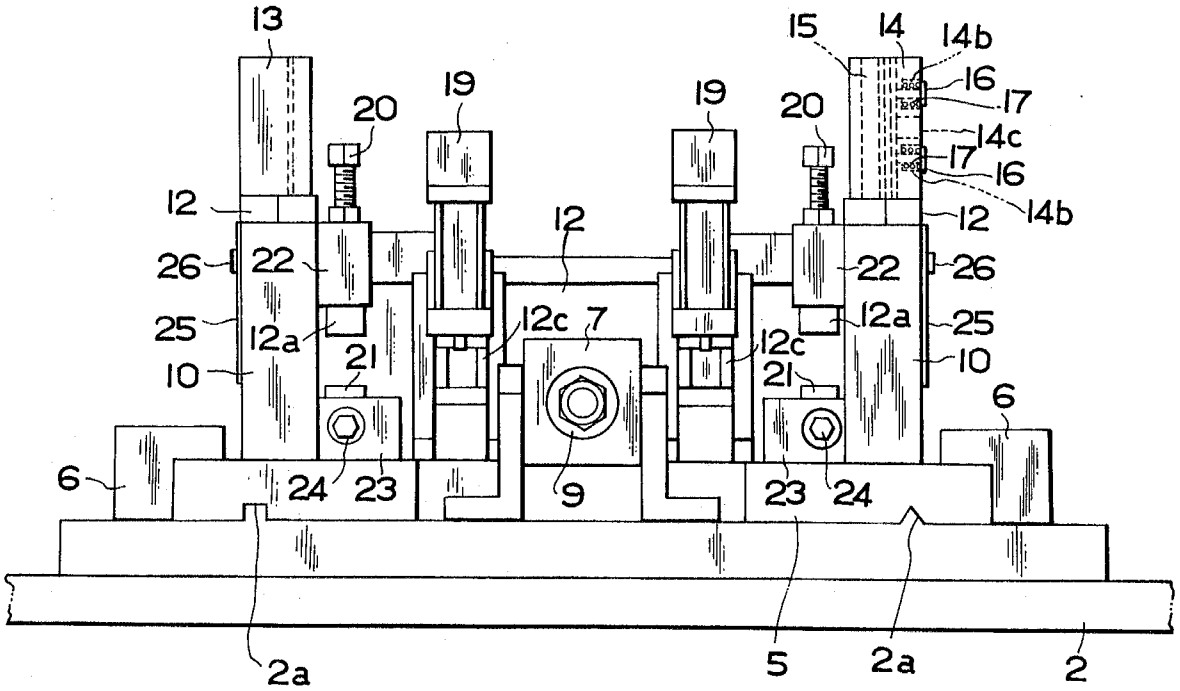

As shown in FIGS. 3 to 5, fitting arms 12*c* extend horizontally from the back side of the angular table 12 and are connected to oil-pressure cylinders 19. Oil-pressure cylinders 19 are mounted at an inclination to the slide base 5 and are paired to operate simultaneously. The angular table 12 is movable to two different angle positions by means of the oil-pressure cylinders 19, thereby changing the support angle of the tube-element 18 relative to a grinding surface 75*a* of a grinding wheel 75.

As shown in FIG. 3, the two angle positions of the angular table 12 are set by upper limit stoppers 20 and by lower limit stoppers 21. The upper limit stoppers 20 are formed by bolts screwed into metal members 22 provided at the top rear portions of the angular table guides 10. The lower ends of upper limit stoppers 20 are adapted to bear against matching upper surfaces of arms 12*a* extending from angular table 12, to thereby define an upper angle position of table 12. The required upper angle position can be adjusted in a vertical direction by rotation of upper limit stoppers 20 with respect to members 22.

As indicated in FIGS. 3 and 5, the lower limit stoppers 21 have on the top surfaces thereof inclined projections which abut or bear against bottom sloped surfaces at the ends of arms 12*a* to thereby define a bottom angle position of table 12. The lower limit stoppers 21 have extending therethrough male screws 24. The male screws 24 are rotatably fitted through metal members 23 of the slide base 5 at positions below the arms 12*a*. When male screws 24 are turned, the lower limit stoppers 21 are free to move forward or backward in a direction of displacement over the slide base 5. Thereby, the position of contact of the top inclined surfaces of the lower limit stoppers 21 with the bottom surfaces of the arms 12*a* will be changed, and the limit of the lower angle position of the angular table 12 can be adjusted.

The angular table 12 is moved to the position of the upper limit stoppers 20 when the oil-pressure cylinders 19 are OFF and retracted, and to the position of the lower limit stoppers 21 when cylinders 19 are ON and extended. An angular displacement of the angular table 12 causes the tube element holder 11, supported by the angular table 12, to be similarly angularly displaced, and thus the support angle of the tube element 18 is altered.

Accordingly, the support angle of the tube element 18 with the grinding surface 75*a* of the grinding wheel 75 is changed, and the grinding angles $\alpha$, $\beta$ of the main bevel and side bevel which are indicated in FIGS. 16(B), (C) and (D) may be set at various values.

Plates 25, having angle indicia thereon, are fixed to angular table guides 10, and register angle arrows 26 are fixed to the angular table 12, as shown in FIGS. 2, 4 and 5.

The tube element holder guides 13 and 14 are fixed to the top of opposite ends of the angular table 12. As shown in FIGS. 4 to 6, one of the holder guides 13 has formed therein a V-shaped groove 13*a*, while the other holder guide 14 has formed therein a concave groove 14*a* which receives a block 15 having therein a V-shaped groove 15*a* matching V-shaped groove 13*a*. V-shaped groove 13*a* and V-shaped groove 15*a* are on opposite sides of table 12 and face each other. Block 15 is freely movable in the concave groove 14*a* in a direction parallel to V-shaped groove 13*a* in holder guide 13. Bolts 16 extend through holes 14*b* in holder guide 14 and are screwed into the outer or rear surface of block 15. Vertically midway between holes 14*b* in the holder guide 14, i.e. at vertical mid-height of the holder guide 14 there is provided a through hole 14*c*. A pressure member or push rod 47, illustrated in FIGS. 10 and 11, of a slide plate drive 43, to be described below, movably passes through hole 14*c*.

As shown in FIGS. 4 to 6, block 15 is normally withdrawn to the innermost position of the concave groove 14*a* by the elasticity of springs 17, and when a force overcoming the elasticity of springs 17 is applied from pressure member 47 to the block 15, the block 15 moves in a direction toward the V-shaped groove 13*a*.

Figure 7:
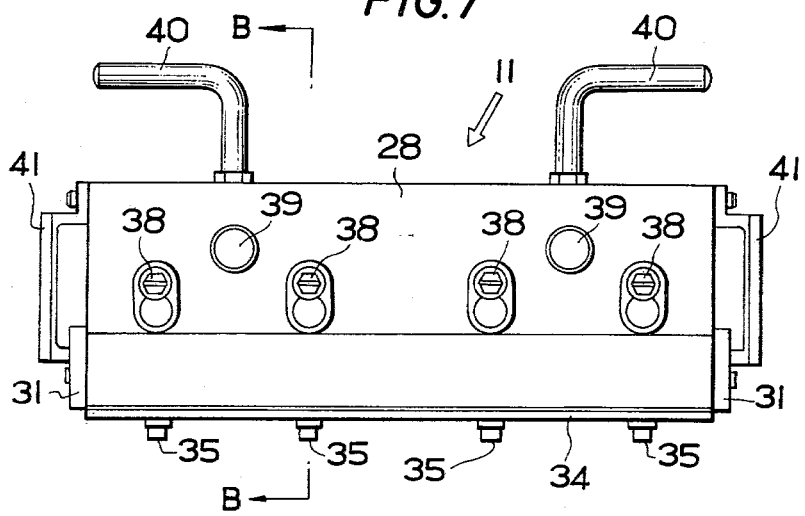
FIG. 7 and FIG. 8 are respectively a plane view and a front elevation view of the tube holder.
Figure 8:
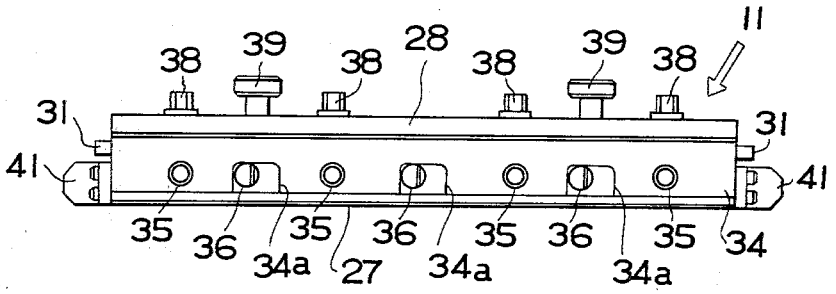
Figure 9:
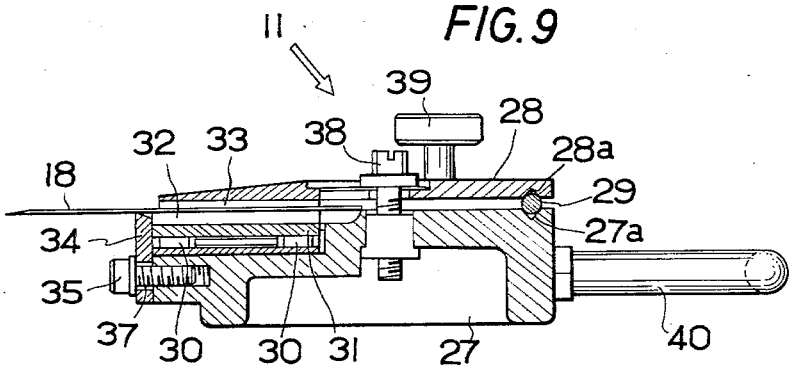
FIG. 9 is a section along line B—B of FIG. 7.

The tube element holder 11 fits within and between the V-shaped grooves 13*a* and 15*a*, and is held therebetween and clamped by the forward movement of the block 15. The tube element holder 11 is designed such that, as illustrated in FIGS. 7 to 9, a plurality of tube elements 18 can be supported in a parallel manner between a pair of holding plates. The pair of holding plates include an oblong body 27 and a similarly oblong cover 28. At internally opposed positions at one end of holder 11, are formed V-shaped grooves 27*a* and 28*a* which extend over the entire lengths of body 27 and cover 28, respectively. During the grinding process, a tube element 18 is pressed against the oblong body 27 by the grinding surface 75*a* of rotating grinding wheel 75.

Between the V-shaped grooves 27*a* and 28*a*, as shown in FIG. 9, is interposed a space adjusting columnar bar 29 to adjust the space between the body 27 and the cover 28 of the holder 11, in accordance with the outer diameter of the tube element 18 to be ground. Inside of the holding plate body 27, on the side thereof opposite groove 27*a*, there is provided a longitudinal slide plate 31 fitted on a slide needle bearing 30 and extending over substantially the entire length of body 27. The outer or top side of slide plate 31 is coated with a friction resistance member 32, such as a rubber plate. Inside of the holding plate cover 28, on the side thereof opposite groove 28*a*, there is provided a longitudinal friction resistance member 33, such as a rubber plate, which faces the friction resistance member 32.

The degree of or position to which the tube element 18 is pressed by the grinding wheel 75 toward the holding plate body 27 is determined by a height adjusting plate 34 which has a width equal to the adjacent portion of holding plate body 27 and which is bolted by bolts 35 to holding plate body 27, such that plate 34 can be tightened, loosened and vertically moved. Notches 34*a* are formed at equal intervals in the longitudinal direction of height adjusting plate 34, and cams 36 are rotatably mounted on holding plate body 27 to fit within notches 34*a*. Rotation of cams 36 causes a relative vertical shift of height adjusting plate 34 with respect to holding plate body 27. On opposite sides of each notch 34*a*, four equally spaced bolt guide slots 37 extend through plate 34. Slots 37 extend in the direction of vertical adjusting movement of height adjusting plate 34. Bolts 35 extend through slots 37, and by rotation of bolts 35 height adjusting plate 34 can be tightened to or loosened from the holding plate body 27.

The top side of height adjusting plate 34, i.e. the side thereof which comes into contact with the tube element 18 when the tube element 18 is held between the two friction resistance members 32 and 33, is coated with Teflon to prevent the tube element 18 from being abraded when held or turned.

Bolts 38 extend through the body 27 and the cover 28 of the holder 11, at positions between space adjusting bar 29 and height adjusting plate 34. Bolts 38 are spaced at equal intervals, and by unbolting bolts 38 the body 27 and the cover 28 of the holder 11 can be disassembled.

Knobs 39 are provided for the removal of holding plate cover 28, handles 40 are provided for grasping body 27, and guides 41 are provided for receipt in grooves 13*a* and 15*a*.

Use of the tube element holder 11 will now be described. First, the bolts 38 are loosened to remove the cover 28 and the body 27.

Next a space adjusting bar 29 of a size such that the tube element 18 can be firmly held horizontally between the body 27 and the cover 28, depending on the outer diameter of the tube element 18 to be ground, is inserted in the V-shaped groove 27*a* of the body 27.

Then a required number of tube elements 18 are positioned on the friction resistance member 32, with the protruding ends of elements 18 evenly aligned by a piece of tape.

Next the cover 28 is replaced on the body 27, and the body 27 and the cover 28 are firmly fastened together by fastening the bolts 38.

The tape is then removed from the ends of elements 18.

Then, with the bolts 35 loosened, the cams 36 are turned until the top side of height adjusting plate 34 presses against each tube element 18. With the elements 18 in this pressed condition the bolts 35 are tightened to thereby fix height adjusting plate 34 to the body 27.

Thus, the tube elements 18 are fixed in the tube element holder 11.

The tube elements 18 can be turned about their respective axes by moving the slide plate 31 longitudinally over bearing 30.

As indicated in FIG. 1, on both sides of the angular table 12 there are installed a pair of slide plate drives 42 and 43 which are fixed to the angular table 12 and to the tube element holder guides 13 and 14, respectively.

Figure 10:
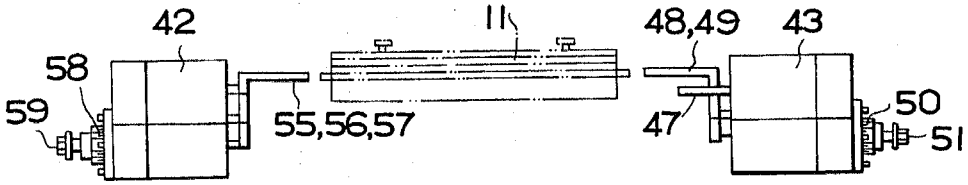
FIGS. 10, 11 and 12 are respectively a plan view, a front elevation view and a side view of the slide plate drive.
Figure 11:
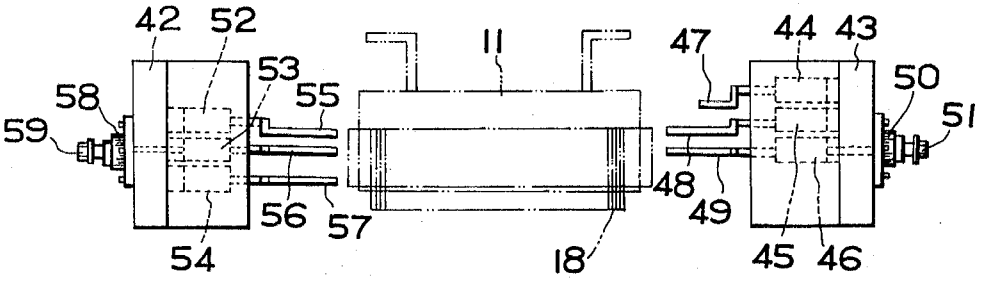
Figure 12:
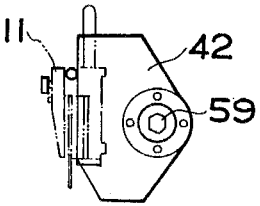

As indicated in FIGS. 10 to 12, the slide plate drive 43 internally supports an oil-pressure cylinder 44 for clamping the tube element holder 11 and oil pressure cylinders 45 and 46 for moving the slide plate 31. Push rods 47, 48 and 49 are respectively connected to oil-pressure cylinders 44, 45 and 46. The oil-pressure cylinder 46 for the slide plate 31 is equipped with a fine stroke control device 51 having a dial plate 50. The stroke of cylinder 46 can be varied by control device 51, thereby changing the amount of shifting of the slide plate 31. The fine stroke control device 51 may be of known construction, such as the construction of fine stroke adjusting mechanism 9 of oil-pressure cylinder 27 for the slide base 5.

The slide plate drive 42 internally supports oil-pressure cylinders 52, 53 and 54 for moving the slide plate 31, and the push rods 55, 56 and 57 are respectively connected to cylinders 52, 53 and 54. The oil-pressure cylinder 53, in a manner similar to that of cylinder 46, is equipped with a fine stroke control device 59 having a dial plate 58 to make the stroke variable. The fine stroke control device 59 may be of known construction, such as that of fine stroke adjusting mechanism 9.

The tip or free end of the push rod 47 contacts the approximate mid-height position of the block 15, as shown in FIG. 6, when the oil-pressure cylinder 44 is ON and extended, thereby pushing the block 15 toward the holder guide 13 against the force of the springs 17. Thus, the gap between the V-shaped grooves 13*a* and 15*a* is narrowed and the tube element holder 11 is clamped therebetween.

The push rods 48 and 49 and 55, 56 and 57 are located adjacent the sides of the respective tube element holder guides 13 and 14, and are moved forward in a respective direction toward the slide plate 31 when the respective oil-pressure cylinders 45 and 46 or 52, 53 and 54 are ON and extended. Thereby, the tips of the push rods 48 and 49 or 55, 56 and 57 contact one end of the slide plate 31 and longitudinally drive the slide plate 31, until the opposite end of slide plate 31 contacts with the tips of the push rods 55, 56 and 57 or 48 and 49 located ahead of the slide plate 31, to thus limit the shifting of the slide plate 31.

The strokes and diameters of the oil-pressure cylinders internally supported within the slide plate drives 42 and 43 are listed in the following table.

| Cylinders | Stroke (mm) | Diameter (mm) |
|---|---|---|
| 44 for clamping holder 11 | 5 | 22 |
| 45 for moving slide plate 31 | 7 (maximum) | 22 |
| 46 for moving slide plate 31 | 12 | 16 |
| 52 for moving slide plate 31 | 6 | 22 |
| 53 for moving slide plate 31 | 7 (maximum) | 22 |
| 54 for moving slide plate 31 | 12 | 16 |

Figure 13:
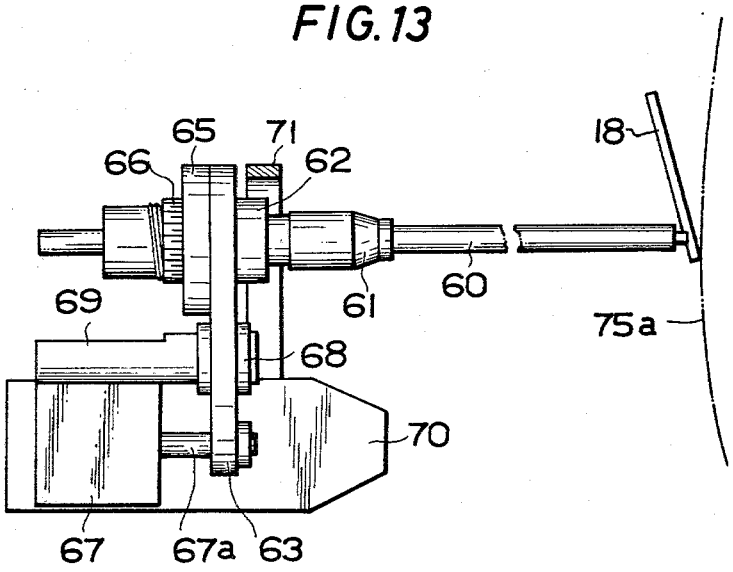
FIGS. 13 and 14 are respectively a side view and a partially enlarged section of the air nozzle structure.
Figure 14:
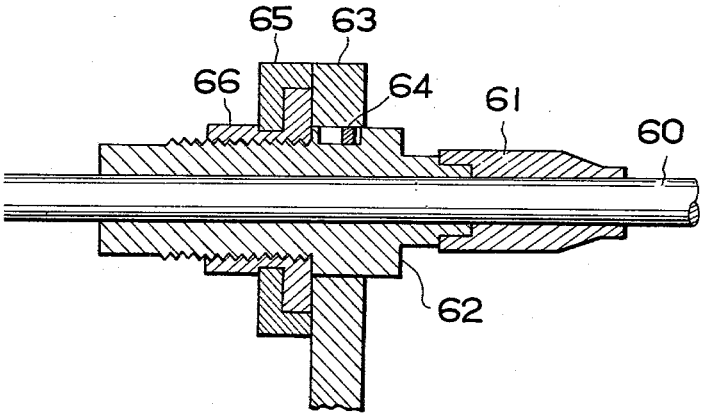

As indicated in FIG. 1, an air nozzle 60 is installed at the right side of slide base 5, as viewed in the direction of movement of the slide base 5 toward the saddle 3. Air nozzle 60 extends beneath angular table 12, angular table guide 10 and the slide plate drive 43, and the tip of nozzle 60 extends to a position adjacent the grinding surface of grinding wheel 75, to be described below. As shown in FIGS. 13 and 14, air nozzle 60 is supported by a nozzle holder 61 and a holder 62 and is thereby attached to an air nozzle arm 63. The level of the tip of the air nozzle 60 substantially corresponds to the vertical level of the tips of the tube elements 18 and of the center rotation of the grinding wheel 75. The holder 62 extends through the air nozzle arm 63 and is slidable forwardly and rearwardly with respect thereto, but is prevented from rotation with respect thereto by a key 64 attached between air nozzle arm 63 and holder 62. Air nozzle arm 63 has a dial plate 66 rotatably fitted thereto by a ring 65.

The holder 62 extends through and is in threaded engagement with dial plate 66. Accordingly, as a result of turning the dial plate 66, the holder 62 and the air nozzle 60 fixed thereto are slightly moved forwardly or rearwardly in the direction of movement of the slide base 5 toward the saddle 3, thereby effecting a fine positional adjustment of the tip of nozzle 60.

The air nozzle arm 63 has a lower end connected to the piston rod 67*a* of an air nozzle cylinder 67, and has a slide bearing bushing 68 provided at the mid-height position thereof, with a guide bar 69 extending into bushing 68. One end of the guide bar 69 is fixed to the top of the air nozzle cylinder 67. Therefore, the action of air nozzle cylinder 67 causes a large forward or backward movement of the air nozzle arm 63 along the guide bar 69 in the direction of movement of the slide base 5 toward the saddle 3. Thus, the tip of air nozzle 60 is movable up to the grinding surface 75*a* of the grinding wheel 75. The air nozzle cylinder 67 is fixed to the right side, as viewed in FIG. 1, of angular table guide 10 by means of a fitting plate 70. A stopper for limiting the forward movement of the air nozzle 60 is fixed to the right side of angular table guide 10.

The saddle 3, as shown in FIGS. 1 and 2, has formed in the bottom surface thereof grooves which match ribs 1*d* formed on the top side of the saddle bed 1*b*, and saddle 3 is thus slidably mounted on the saddle bed 1*b* for movement toward and away from the grinder table 2. On a bracket 1*e* of the saddle bed 1*b* there is supported a pulse motor 72 and a gear box 73 connected to pulse motor 72. As shown in FIG. 2, the saddle 3 has a downwardly depending central portion 3*a* through which is threadably extended a drive shaft 74 connected via gear box 73 to pulse motor 72. Thus, rotation of the pulse motor 72 is transmitted via the drive shaft 74 to the depending central portion 3*a* of the saddle 3, thereby moving the saddle 3 forwardly or rearwardly in the direction of the drive shaft 74. The engaging screws of the drive shaft 74 and the central portion 3*a* are designed with such precision that one pulse of the pulse motor 72 causes a shift of 0.01 mm of the central hanging portion 3*a*, i.e. of the saddle 3.

On the portion of saddle 3 adjacent grinder table 2 there is provided a grinding wheel 75 having a grinding surface 75*a*. The grinding wheel 75 is connected via grinding support 80, pulleys 77 and 78 and the belt 79 to a drive motor 76.

Figure 15:
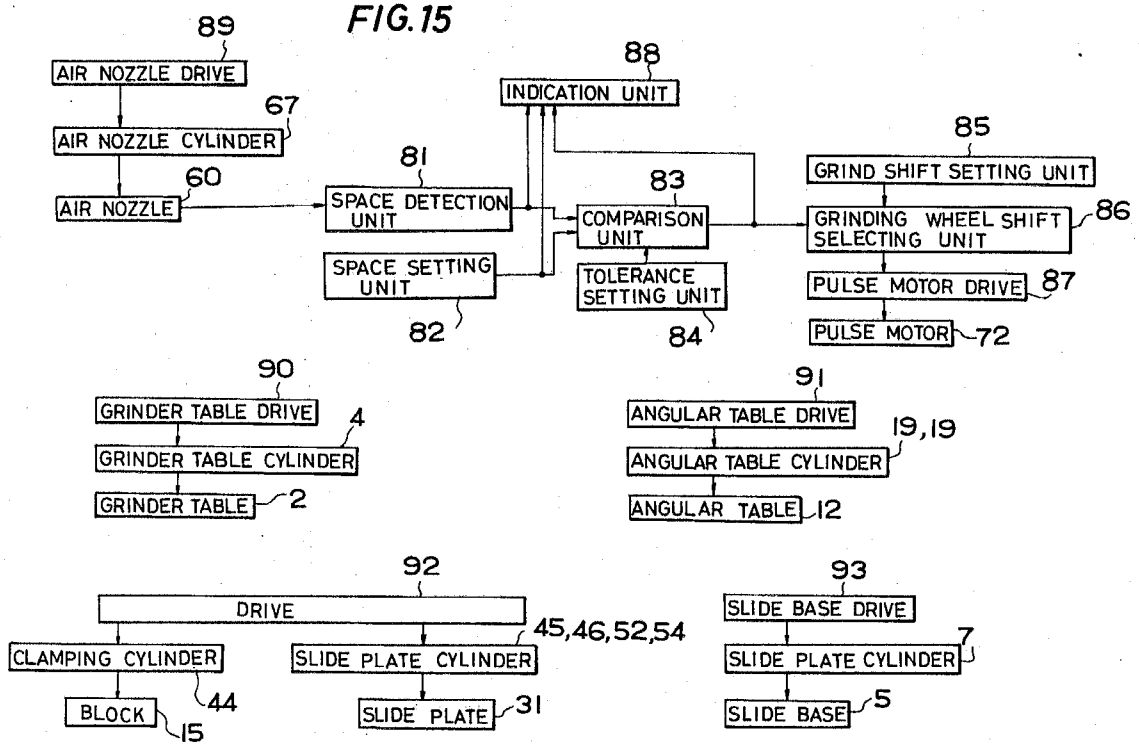
FIG. 15 is a block diagram of the controller.

FIG. 15 is a block diagram illustrating the control system of the invention. A space detection unit 81 serves to detect the space between the tip of the air nozzle 60 and the grinding surface 75*a* of the grinding wheel 75 and to emit an electric signal representative thereof. Detection unit 81 and air nozzle 60 may together form a well-known air micrometer.

A space setting unit 82 serves to preset the space between the tip of the air nozzle 60 and the grinding surface 75*a* of the grinding wheel 75 by means of, for example, a digital switch. The preset value of the space is equal to the standard space between the slide base 5 to which the air nozzle 60 is attached and the grinding surface 75*a* of the grinding wheel 75, minus the length of the air nozzle 60 extending from slide base 5 when the space is detected.

From the characteristic of the air micrometer formed by the air nozzle 60 and the space detection unit 81, there must be an optimum value for detection of the space between the tip of the air nozzle 60 and the grinding surface 75*a* of the grinding wheel 75, and usually this value is taken as the preset value for the space setting unit 82. When the standard space between the slide base 5 and the grinding surface 75*a* of the grinding wheel 75 is changed, the space between the tip of the air nozzle 60 and the grinding surface 75*a* of the grinding wheel 75 must always be optimized for space detection through adjustment of the length of the air nozzle 60 extending from slide base 5. This is done by moving nozzle 60 forwardly or rearwardly by rotation of the dial plate 66.

The output of the space setting unit 82 is, as is the output of the space detection unit 81, given as an electric signal to a comparison unit 83. The comparison unit 83 compares the space value detected by the detection unit 81 and the space value set by the setting unit 82. When there is a difference between these two values and the difference exceeds the value set by a tolerance setting unit 84, such difference is given as an electric signal.

A grind shift setting unit 85 serves to preset a forward shift of the grinding sheel 75 from the standard space. Depending on the mode of grinding, usually several values are available.

In the present embodiment the total grinding volume is split into four SETS, which are stored in the grind shift setting unit 85.

The grinding wheel shift selecting unit 86 serves to select the shift volume and direction (forward or backward) of the grinding wheel 75, based on the output of the comparison unit 83 and the output of the grind shift setting unit 85.

The shifting of the grinding wheel 75 is effected by the shifting of the saddle 3.

A pulse motor drive 87 converts the output of the grindstone wheel shift selecting unit 86 to a pulse signal and supplies such pulse signal to the pulse motor 72, to thereby drive pulse motor 72.

The pulse motor 72 drives the saddle 3 by a minimum unit of length, and this minimum unit is set for the tolerance setting unit 84, while the value of the minimum unit set for the grind shift setting unit 85 is made equal to the minimum unit to drive the saddle 3 by the pulse motor 72.

An indication unit 88 digitally indicates the outputs of the space setting unit 82, the space detection unit 81 and the comparison unit 83 for the monitoring purposes.

An air nozzle drive 89 moves, by the action of the air nozzle cylinder 67, the air nozzle 60 to two positions, i.e. forward and backward positions. The air nozzle 60 is set at the forward position for the purpose of adjusting the space and at the backward position for the purpose of grinding.

As for the characteristic of the air micrometer consisting of the air nozzle 60 and the space detection unit 81, a space of about 0.30 mm between the tip of the air nozzle 60 and the detected surface, i.e., the grinding surface 75*a* of the grinding wheel 75 is most desirable for detection accuracy. Thus, the value for the space setting unit 82 is set at 0.30 mm.

Meanwhile, the minimum unit for driving the saddle 3 by the pulse motor 72 is, as mentioned above, 0.01 mm, and the values of the minimum units set for the tolerance setting unit 84 and for the grind shift setting unit 85 are also 0.01 mm.

A grinder table drive 90 serves to reciprocate the grinder table 2 for a grinding operation, and the output of drive 90 is transmitted to the grinder table cylinder 4 to thereby drive the grinder table 2.

An angular table drive 91, depending on the mode of grinding, changes the angle of the angular table 12 along the guide grooves 10*a* of the angular table guides 10 and thus changes the angle at which the tube elements 18 are held in relation to the grinding surface 75*a* of the grinding wheel 75. The output of drive 91 is transmitted to the angular table cylinders 19.

A drive 92 drives the slide plate drives 42 and 43, thereby clamping the tube element holder 11 for grinding, and driving the slide plate 31 for rotating each tube element 18 about its axis. The output of drive 92 is supplied to the clamping cylinder 44 and to the slide plate cylinders 45 and 46 and 52, 53 and 54.

A slide base drive 93 serves to move the slide base 5 forward or backward to change the spacing between the grinding wheel 75 and the slide base 5, depending on the stage of grinding operation and on the kind of material to be ground. The output of the slide base drive 93 is supplied to the slide base cylinder 7.

Figure 16:
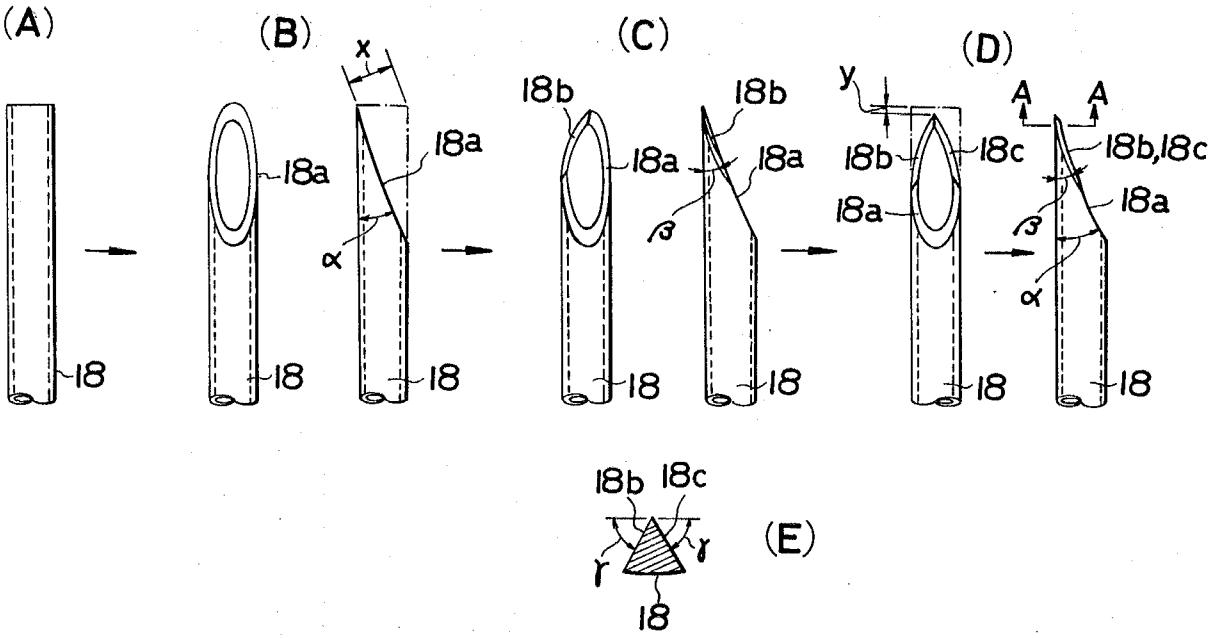
FIGS. 16(A) through (E) are views illustrating the principle of grinding a tube.

FIG. 16 illustrates each stage of the grinding operation of a needle tube element 18 to form a syringe. A tube element 18 in FIG. 16(A) has a main bevel 18*a* therein, as shown in FIG. 16(B). Next, the hold angle of the tube element 18 relative to the grinding surface 75*a* of the grinding wheel 75 is changed, and the slide plate 31 is moved by a first specific distance so that all tube elements 18 held by holder 11 are turned about their axes. Thus, as shown in FIG. 16(C) one of the bevels 18*b* is ground. Then the slide plate 31 is moved by an amount equal to twice the first moved distance, in a direction reverse to the earlier movement. As a result, the tube elements 18 are turned in the opposite direction about their axes. Thus as illustrated in FIG. 16(D), the other of the side bevels 18*c* is ground. FIG. 16(E) is an enlarged section view along line A—A of FIG. 16(D).

Figure 17:
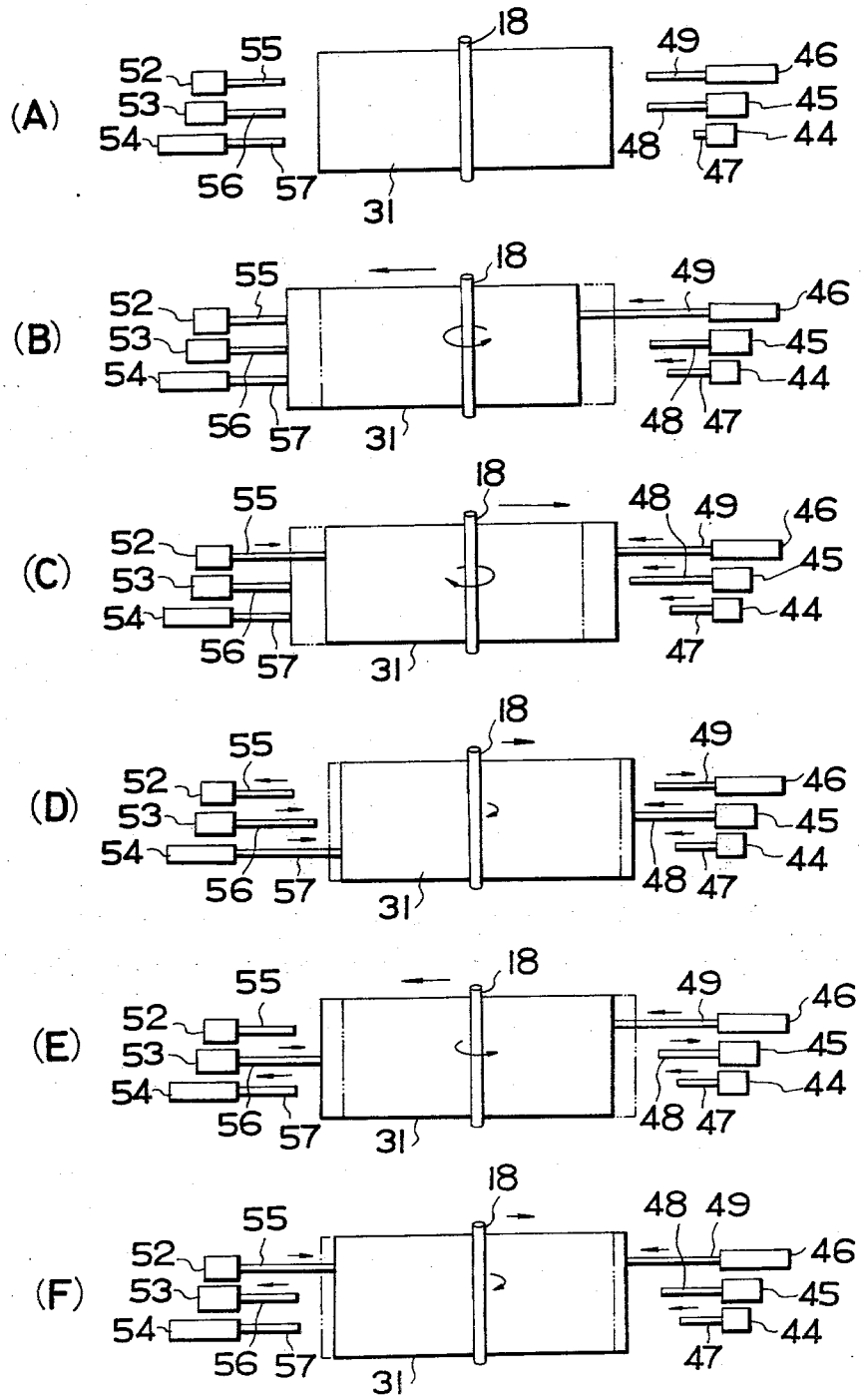
FIGS. 17(A) through (F) are schematic diagrams illustrating the action of the slide plate.

FIG. 17 shows the sliding sequence of operations to move the slide plate 31. In FIG. 17, the oil-pressure cylinder 44 for clamping and the oil-pressure cylinders 45, 46, 52, 53 and 54 for moving the slide plate, when they have been changed to ON from OFF, or when they are still ON, are shown with an arrow pointing toward the slide plate 31, and when they have been changed to OFF from ON, they are affixed with an arrow pointing in a reverse direction away from the slide plate 31. Only one typical tube element 18 is illustrated in its initial crude state, i.e. not illustrating profile changes due to grinding. In FIG. 17(A) the cylinders 44 to 46 and 52 to 54 are shown in the OFF state, while in FIGS. 17(B) and (C) leveling operations to straighten the row of tube elements 18 are illustrated. In FIGS. 17(D) and (E), the operations for changing the rotational positions of the tube element for the side bevel grinding operations are illustrated. Main bevel grinding follows the operation shown in FIG. 17(B), and side bevel grinding follows each operation shown in FIGS. 17(D) and (E). The operations of FIG. 17 will be described in detail below, together with the entire operation.

In the automatic grinder for forming a syringe needle point thus constructed, when the grinding wheel 75 is replaced with a new one, the manual operation described below takes place, and thereafter with a wearing of the grinding wheel 75 as the result of automatic grinding, the grinding operation is automatically adjusted.

As shown in the embodiment illustrated above, the amounts of movement for the grind shift, the slide base shift, the change of the hold angle of the tube element 18 and the change of the angular position of the tube element 18 about its axis are variable to desired or required values. Not only one, but also several modes of grinding can be executed with changes in the tube element diameter, the grinding length and the grinding angle.

The operation of the device of the invention and the grinding operation achieved thereby will now be described.

Initially, the following exemplary and non-limiting values will be established:

Setting for space setting unit 82=0.30 mm.

Value for tolerance setting unit 84=0.01 mm.

Grind shift setting unit. Shift (x in FIG. 16(B)) of the grinding wheel 75 for grinding the main bevel 18*a* is set in SET 1 through SET 4, to thus grind the main bevel in four sets or stages. The ratio is 70% for SET 1, 15% for SET 2, 10% for SET 3 and 5% for SET 4.

Slide base cylinder 7. The stroke is set equal to the shift (y shown in FIG. 16(D)) of the slide base for grinding the side bevels 18*b* and 18*c*.

Upper limit stoppers 20. Set to the grinding angle ($\alpha$ in FIGS. 16(B), (C) and (D)) for the main bevel 18*a*.

Lower limit stoppers 21. Set to the grinding angle ($\beta$ in FIGS. 16(C) and (D)) for the side bevels 18*b* and 18*c*.

Slide plate cylinders 46 and 53. Set to a stroke which turns tube element 18 just by the grinding angle ($\gamma$ in FIG. 16(E)) for the side bevels 18*b* and 18*c*. This stroke depends on the outer diameter of the tube element 18. Assume FIG. 17 shows setting of 4 mm.

The position of origin when the grinding wheel 75 is renewed is set according to (A) and (B) below, to be ready for an automatic grinding operation:

(A) With the slide base 5 and the saddle 3 at their rearward or spaced apart positions, the angular table cylinders 19 are set ON, and the angular table 12 is set to the angle $\alpha$ for grinding the main bevel 18*a* of the tube element 18. The saddle 3 is moved toward the grinder table 2 so that the tip of the tube element 18 will be contacted by the grinding surface 75*a* of the grinding wheel 75.

(B) In this state the air nozzle cylinder 67 acts to move the air nozzle 60 forwardly. Then, watching the indication unit 88 shown in FIG. 15, by turning the dial plate 66 the tip of the air nozzle 60 is brought close to the grinding surface 75*a* of the grinding wheel 75, i.e. to a spacing of 0.30 mm equal to the set value of the space setting unit 82.

Figure 18:
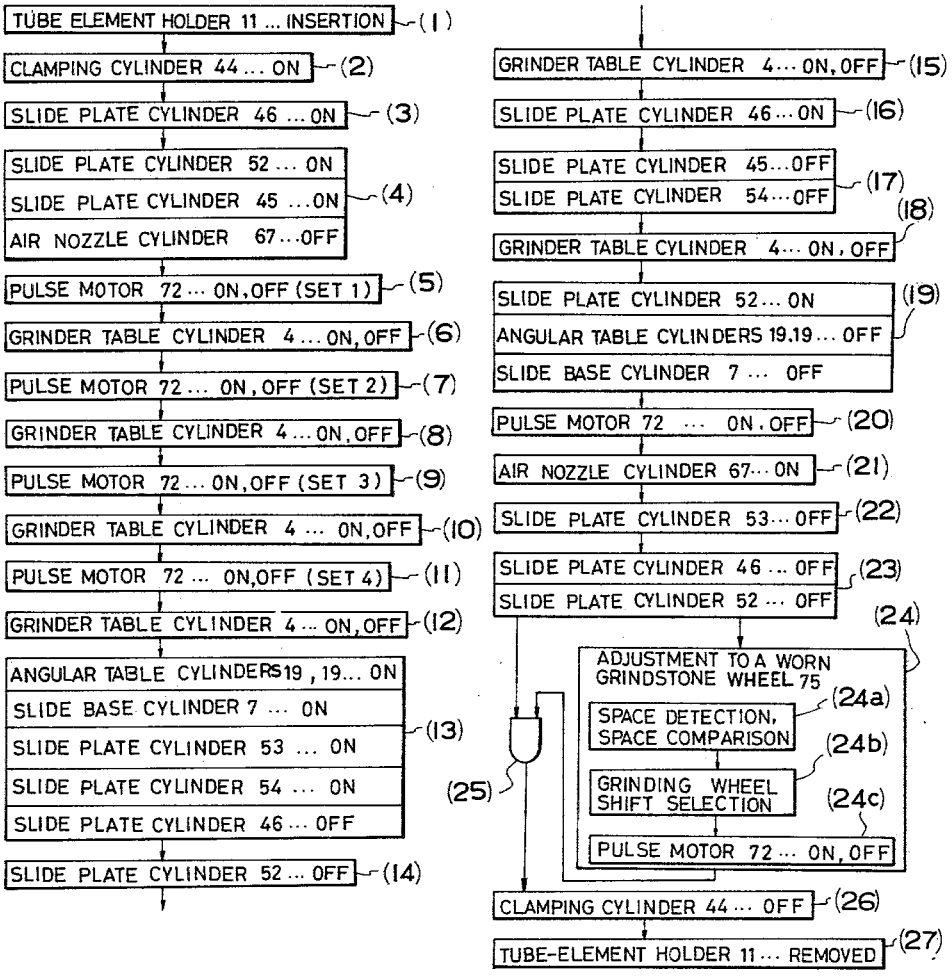
FIG. 18 is a flow chart illustrating the control program.

Thereafter automatic grinding of the tube element point is achieved according to the program shown in FIG. 18.

Next the process of grinding the needle point is described.

Controlling of the process is achieved by means of the respective controls in the pulse motor drive 87, the air nozzle drive 89, the grinder table drive 90, the angular table drive 91 and the slide plate drive 92, but the following description deals only with the movement of the driven object.

(1) Insertion of the tube element holder 11.

The tube element holder 11 is inserted between the block 15 and the tube element holder guide 13. Thereby, the tube element holder fitting guides 41 are positioned within the V-shaped groove 13*a* and the V-shaped groove 15*a*.

(2) The clamping cylinder 44 . . . ON

The clamping cylinder 44 of the slide plate drive 43 is set ON to move the push rod 47 forward. Thereby a force overcoming the springs 17 acts to move the block 15 toward the V-shaped groove 13*a*. As a consequence, the space between the V-shaped groove 13*a* and the V-shaped groove 15*a* is narrowed and the tube element holder 11 is clamped.

(3) The slide plate cylinder 46 . . . ON

As indicated in FIG. 17(B), cylinder 46 moves the slide plate 31 leftwardly until its left side contacts the push rods 55, 56 and 57, and as a consequence all the tube elements 18 are simultaneously rotated.

(4) Slide plate cylinder 52 . . . ON

Slide plate cylinder 45 . . . ON

Air nozzle cylinder 67 . . . OFF

By the operation of these cylinders, as indicated in FIG. 17(C), the left side of slide plate 31 is pushed by the push rod 55 of the cylinder 52. The right side of the slide plate 31 is pressed by the push rod 49 of the previously actuated oil-pressure cylinder 46. However, since the diameter of the cylinder 52 is larger than that of the cylinder 46, the slide plate 31 is moved in a direction back toward its original position (i.e. to the right) by the total stroke of the cylinder 52, that is by the same distance it was moved in step (3), thereby bringing the tube element 18 to the neutral position. Meanwhile, the oil-pressure cylinder 45 is also ON, but this does not affect the movement of slide plate 31.

At the same time, the air nozzle cylinder 67, which has been ON (when the grinding process is repeated), is set OFF and the air nozzle 60 is retracted.

Thus by the leveling actions of steps (3) and (4), the tube elements 18 are turned in opposite directions by shifting the slide plate 31, and all the tube elements 18 are arranged straight on the tube element holder 11.

(5) Pulse motor 72 . . . ON, OFF (SET 1)

The saddle 3 is moved forward, i.e. toward grinder table 2, just by the shift of SET 1 in the grind shift setting unit 85, and as a consequence the grinding wheel 75 moves forward.

(6) Grinder table cylinder 4 . . . ON, OFF

The grinder table 2 is moved from left to right as shown in FIG. 1.

(7) Pulse motor 72 . . . ON, OFF (SET 2)

The saddle 3 and the grinding wheel 75 are moved forward just by the shift of SET 2 in the grind shift setting unit 85.

(8) Grinder table cylinder 4 . . . ON, OFF (9) Pulse motor 72 . . . ON, OFF (SET 3)

The saddle 3 and the grinding wheel 75 are moved forward just by the shift of SET 3 in the grind shift setting unit 85.

(10) Grinder table cylinder 4 . . . ON, OFF

The grinder table 2 is moved from the left to right as shown in FIG. 1.

(11) Pulse motor 72 . . . ON, OFF (SET 4)

The saddle 3 and the grinding wheel 75 are moved forward just by the shift of SET 4 in the grind shift setting unit 85.

(12) Grinder table cylinder 4 . . . ON, OFF

The grinder table 2 is moved from right to left as shown in FIG. 1.

In steps (6), (8), (10) and (12) of the above grinding process, including steps (5) to (12), the grinding of the main bevel 18*a* is achieved in four stages.

(13) Angular table cylinders 19 . . . ON
Slide base cylinder 7 . . . ON
Slide plate cylinder 53 . . . ON
Slide plate cylinder 54 . . . ON
Slide plate cylinder 46 . . . OFF When the angular table cylinders 19 are set ON, the angle of the angular table 12, i.e. the hold angle of the tube element 18, is changed, and the tube elements 18 which are held on the angular table 12 by means of the holder 11, are set to the angle $\beta$for grinding the side bevels 18*b* and 18*c*.

At the same time the slide base cylinder 7 is set ON, and the slide base 5 is moved forward, i.e. toward the grinding wheel, by just the distance necessary for grinding the side bevels 18*b* and 18*c*.

At the same time, as indicated in FIG. 17(D), the slide plate cylinders 53 and 54 become ON, while the slide plate cylinder 46 becomes OFF. As a consequence, the slide plate 31 is pushed from the left side by the push rod 57 of the slide plate cylinder 54 and is moved thereby in the right direction until the right side of slide plate 31 contacts the push rod 48 of the slide plate cylinder 45. This movement causes the tube elements 18 to be turned or rotated about their axes by the angle $\gamma$for grinding the side bevel 18*b*.

(14) Slide plate cylinder 52 . . . OFF

Though shown together with step (13) in FIG. 17(D), the action of this cylinder does not move the slide plate 31.

(15) Grinder table cylinder 4 . . . ON, OFF

The grinder table 2 moves from left to right as shown in FIG. 1, and one of the side bevels 18*a* is ground.

(16) Slide plate cylinder 46 . . . ON
(17) Slide plate cylinder 45 . . . OFF
Slide plate cylinder 54 . . . OFF As a result of steps (16) and (17), as illustrated in FIG. 17(E), the slide plate 31 is pushed from the right side by the push rod 49 of the slide plate cylinder 46 and is moved leftward by a distance equal to twice the leftward shift in step (14), until the left side of the slide plate 31 contacts the push rod 56 of the slide plate cylinder 53. As a consequence, the tube elements 18 are rotated about their axes in a direction reverse to the direction of rotation in step (14), and by twice the angular rotation thereof, i.e. by twice angle $\gamma$, for grinding the other side bevel 18*c*.

(18) Grinder table cylinder 4 . . . ON, OFF

The grinder table 2 is moved from right to left as shown in FIG. 1, and the grinding of the other side bevel 18*c* takes place.

(19) Slide plate cylinder 52 . . . ON
Angular table cylinders 9 . . . OFF
Slide base cylinder 7 . . . OFF As indicated in FIG. 17(F), when the slide plate cylinder 52 becomes ON, the left side of slide plate 31 is pushed by the push rod 55 of the slide plate cylinder 52 and is moved to the right until its right side contacts the push rod 49 of the slide plate cylinder 46, and thereby the tube element 18 is restored to the neutral position.

At the same time the angular table cylinders 19 become OFF, and thereby the inclination of the angular table 12, i.e. the hold angle of the tube element 18, is restored to the original angle for grinding the main bevel 18*a*.

At the same time the slide base cylinder 7 becomes OFF, and thereby the slide base 5 is moved back to the original position for grinding the main bevel 18*a*.

(20) Pulse motor 72 . . . ON, OFF

The saddle 3 and the grinding wheel 75 are moved back just by the total shift of SET 1 thorugh SET 4 in the grind shift setting unit 85 to the original position or origin.

(21) Air nozzle cylinder 67 . . . ON

The air nozzle 60 is moved forward to be ready for adjustment of the grinding surface of the now worn grinding wheel 75.

(22) Slide plate cylinder 53 . . . OFF

This is shown together with step (19) in FIG. 17(F), but does not result in movement of the slide plate 31.

(23) Slide plate cylinder 46 . . . OFF
Slide plate cylinder 52 . . . OFF

The slide plate 31 is now liberated from the restraints of all of the cylinders 45, 46, 52, 53 and 54.

(24) Adjustment to a worn grinding wheel 75

In conjunction with step (23), adjustment for wear of the grinding wheel 75 is made as follows.

(24*a*) The space between the grinding surface 75*a* of the grinding wheel 75 and the tip of the air nozzle 60 is detected by the space detecting unit 81, and an output representative thereof is sent to the comparison unit 83, where such output is compared with the space set in the space setting unit 82, i.e. 0.30 mm.

When the grinding wheel 75 is worn by the previous grinding operation, thus causing a difference between the detected space and the set space, and when this difference exceeds 0.01 mm, then such difference is supplied as an output from the comparison unit 83 for a shift adjustment.

(24b) This output for a shift adjustment is supplied to the grinding wheel shift selecting unit 86, which selects or determines the shift for the grinding wheel 75.

(24c) This shift is supplied via the pulse motor drive 87 to the pulse motor 72, and thereby the grinding wheel 75 is moved forward, i.e. toward nozzle 60, by an amount such that the space between the grinding surface 75*a* of the grinding wheel 75 and the tip of the air nozzle 60 is again equal to the value set by the space setting unit 82, i.e. 0.30 mm. Thus a new origin position of the grinding wheel is established.

(25) Confirmation of the conclusion of the steps (23) and (24).

Proceed to the next step (26) from AND condition of steps (23) and (24).

(26) Clamping cylinder 44 . . . OFF

When the clamping cylinder 44 becomes OFF, the push rod 47 is moved back and the force acting on the block 15 to urge block 15 toward the V-shaped groove 13*a* is removed.

Thereupon the block 15 is moved back by the springs 17, thereby enlarging the space between the V-shaped grooves 13*a* and 15*a* and unclamping the tube element holder 11.

(27) The tube element holder 11 . . . removed.

The tube element holder 11 is removed from the space between the block 15 and the tube element holder guide 13, and thus the grinding cycle is completed.

All the tube elements 18 as they are removed are arranged in neutral positions. According to the above-mentioned program, the point of each of the tube elements is formed.

In the above discussion, control of the operations has been described with reference to the block diagram of FIG. 15 and the control program of FIG. 18. The specific structure and configuration of the circuits employed to achieve such control do not in and of themselves form the present invention and thus are not described in further detail. Circuitry to achieve the control functions herein described and diagramed could be achieved by known techniques readily understood by those skilled in the art.

In the control program of FIG. 18, instead of shifting the grinding wheel 75 by ON, OFF operations of the pulse motor 72 alone as described in step (24c), it is possible to memorize the shift necessary to achieve movement of the grinding wheel through SET 1 in step (5). That is, the correcting movement of step (24c) can be added to the movement for grinding the first portion of the main bevel, thereby making a simultaneous shifting when SET 1 is executed. In this way the driving times of the pulse motor 72 can be reduced, and accordingly the time necessary for the overall process can be shortened.

In the above-mentioned device it is also possible to grind a special or modified syringe needle, for example, with points at both ends, by modifying the control program and by correspondingly changing the grind shift as necessary. In this case, since one end of the tube element is always ground with the tube element set at a neutral position, there is no need to reset it to the neutral position when the other end is to be ground. Thus, the points arranged at both ends can be easily ground.

In the above-described embodiments, a pulse motor is employed to drive the saddle. However, instead of the pulse motor, a servo motor may be employed.

With the above configuration of the automatic grinder for grinding a syringe needle point according to the present invention, the point of a syringe needle is automatically ground by a programmed process. Accordingly, there is no need for intervention of a skilled worker in mid-process, thereby reducing manpower requirements. Also, a large number of syringe needles can be produced to the same specification with a remarkably increased efficiency.

Particularly, the space adjusting device maintains a constant spacing between the tube element holder and the plane of the grinding surface. Space adjustment by this device is included in the program of the overall operation, and thereby adjustments to compensate for a worn grinding surface are made automatically at specific intervals. Thus, the amount of grinding is constant at all times, and with no products rejected due to a shortage or an excess of grinding, the grinder can be operated with high efficiency and with no waste.

In the embodiment illustrated and described above, wherein at least one of the holding plates of the tube element is free to move in a longitudinal direction, such movement of the holding plate causes a simultaneous turning or rotation of the tube elements with the result that the angular alignment of all the tube elements about their axes can be easily and equally changed. When a friction resistance member such as a rubber plate is provided at the tube holding part of the holding plate, the tube elements can be stably held and they can be exactly turned with no damage by the holding pressure. When the movable holding plate is a slide plate installed with a bearing, the slide plate can be smoothly moved by a slight driving force.

When the tube support height adjusting device is provided at the tip of the holding plate where the tube elements are pressed by the grinder, the height of the supported tubes can be adjusted after the tube elements are clamped between the two holding plates. Therefore, all the tube elements can be supported with an arbitrary, constant pressure which can be easily selected, and there is no likelihood of the tube elements being damaged by the pressure of the holding plates. If in this case the contact pressure between the tube element and the height adjusting device is set to match the toughness or rigidity of the tube element to be ground, the tube elements being ground will be minimally deflected, and thus the syringe needles will be produced with that much more precision.

When the height adjusting device is a plate 34 which may be attached by fixed means such as bolts 35 to the holding plate, and when the holding plate has a cam mechanism 36 for adjusting the height of the plate, then height adjustment can be readily made without damaging the tube element by setting the contact pressure between the tube element and the height adjusting plate after loosening the bolts and turning the cam, and then by a mere tightening of the bolts.

When a cushioning material such as Teflon is provided at the contact area of the tube element and height adjusting device, the tube elements can be free from abrasion even when the contact pressure in adjusting the support height, the grinding pressure in the grinder or the turning pressure of the tube element is somewhat excessive.

When a space adjusting device is provided at both holding plates, on the side thereof opposite the side where the tube elements are ground, and when this device is an appropriately thick bar 29 provided in the V-shaped groove extending over the entire length of the two holding plates, taken in the turning direction of the tube elements held between the two plates, the tube elements can be horizontally held without any adjustment when the bar has a thickness matching the outer diameter of the tube elements to be ground. Since the bar extends over the entire length of the holding plates, a large number of tube elements can be uniformly held and turned even if the two plates are strongly tightened by bolts. Thus, no rejects occur in the products, and the tightness of bolting is not likely to have any adverse effects on the other parts.

When the hold angle change device is constructed such that the tube element holder is rotated in a vertical plane orthogonal to the plane of the grinding surface of the grinder around the tip portions of the tube elements being held, it is possible to change the grinding angle alone, without changing the grinding position, and this change can be accomplished smoothly.

When the angular alignment change device is constructed such that it moves the holding plate by acting on both ends thereof, then all the tube elements can be simultaneously rotated by equal and exact amounts about their axes.

When the slide base and the saddle of the grind shift setting unit are slidable, and when the grinder table in the reciprocating device is slidable, shifting of the elements will be horizontal and stable, and fine shifting can be exactly achieved.

When oil-pressure cylinders are employed to respectively drive the tube element holder, the holding plate, the slide base and the grinder table, each such driving movement will be completed very quickly, the time necessary for the overall automatic grinding operation will be shortened, and the movements will be accurate.

When a pulse motor or servo motor is employed to drive the saddle, it will be possible to precisely move the saddle by a very small distance.

When an air micrometer is employed as the means for space detection, the spacing can be measured exactly to a very small tolerance, and only a small area will be necessary for installation of the air nozzle.

When the overall operation includes the step of straightening the array of tube elements by the above discussed holding plate-leveling action employing movement of plate 31, then even the slightest irregularity in the array of tube elements can be corrected, and an incorrect grinding of the syringe needle can be prevented.

As described above, the present invention solves previous difficulties impeding the automation of syringe needle grinding operations and assures the accurate automatic grinding of a syringe needle point.

Although the present invention has been described and illustrated with respect to a preferred embodiment, various modifications may be made to the specifically described and illustrated structural arrangements without departing from the scope of the invention.

What I claim is:

1. An automatic grinder device for grinding a syringe needle point, said grinder device comprising:

tube holder means for supporting in parallel alignment a plurality of syringe needle tubes, said tube holder means comprising two holding plates for clamping therebetween the tubes;

a grinder having a grinding surface positioned adjacent said tube holder means and spaced therefrom by a spacing;

support angle changer means for changing the position of said tube holder means and thereby the angle at which tubes supported by said tube holder means extend toward said grinding surface of said grinder;

rotation means for changing the rotational angular alignment of tubes supported by said tube holder means by rotating the tubes about their longitudinal axes, said rotation means comprising means for moving at least one of said holding plates in a longitudinal direction across tubes held between said holding plates;

said tube holder means further including tube height adjusting means, provided on one of said holding plates at an end thereof at which tubes supported thereby are pressed by said grinder, for adjusting the pressure exerted on the tubes by said grinder;

said tube holder means further including space adjusting means for separating said two holding plates by an adjustable predetermined distance, to thereby enable said tube holder means to accommodate tubes of varying diameter;

grinding volume changer means for moving said grinder across said spacing toward tubes supported by said tube holder means by relatively greater or lesser amounts in accordance with a predetermined volume to be ground from the tubes;

reciprocater means for reciprocating said tube holder means and tubes supported thereby across said grinding surface of said grinder in a direction such that all of the tubes are sequentially and equally ground by said grinding surface;

space adjuster means for determining changes in said spacing due to wear of said grinder and for causing said grinding volume changer means to move said grinder toward said tube holder means until said spacing is corrected to a predetermined value; and grinding control means for controlling the sequence of operation of the above-mentioned said means in accordance with a predetermined program.

2. An automatic grinder device as claimed in claim 1, wherein the portions of said holding plates which contact tubes are provided with friction resistance members.

3. An automatic grinder device as claimed in claim 1, wherein said one movable holding plate comprises a slide plate supported by bearings.

4. An automatic grinder device as claimed in claim 1, wherein said tube height adjusting means comprises a plate removably attached to said one holding plate by fastening means, and cam means on said one holding plate and bearing against said plate for adjusting the relative position thereof with respect to said one holding plate.

5. An automatic grinder device as claimed in claim 4, wherein an edge of said plate contacts tubes supported by said two holding plates, said edge being provided with a cushioning material.

6. An automatic grinder device as claimed in claim 1, wherein said space adjusting means comprises a bar of predetermined thickness positioned in longitudinal facing grooves formed in said two holding plates.

7. An automatic grinder device as claimed in claim 1, wherein said means for moving comprises means for acting at both opposite ends of the movable holding plate.

8. An automatic grinder device as claimed in claim 7, wherein said acting means comprises at least one oil-pressure cylinder.

9. An automatic grinder device as claimed in claim 1, wherein said support angle changer means comprises means for causing said tube holder means to rotate about a longitudinal pivot extending through the tips of all tubes supported by said tube holder means, said longitudinal pivot extending parallel to the turning axis of said grinder.

10. An automatic grinder device as claimed in claim 9, wherein said means for causing said tube holder means to rotate includes an oil-pressure cylinder.

11. An automatic grinder device as claimed in claim 1, wherein said grinding volume changer means comprises a slide base supporting said tube holder means for movement toward said grinder, and a saddle supporting said grinder for movement toward said tube holder means.

12. An automatic grinder device as claimed in claim 11, further comprising an oil-pressure cylinder for moving said slide base toward said saddle, and a pulse motor or servo motor for moving said saddle toward said slide base.

13. An automatic grinder device as claimed in claim 11, wherein said slide base is mounted on a grinder table, and said reciprocater means comprises means for moving said grinder table along a table bed.

14. An automatic grinder device as claimed in claim 13, wherein said means for moving said grinder table comprises an oil-pressure cylinder.

15. An automatic grinder device as claimed in claim 1, wherein said space adjuster means comprises:

(a) a space presetting means to set said spacing between said tube holder means and said grinding surface of said grinder at said predetermined value;

(b) a space detecting means to detect the actual value of said spacing between said tube holder means and said grinding surface of said grinder; and (c) a control means to supply a space correction signal to said grinding volume changer means when a difference is found between said predetermined value set by said space presetting means and said actual value detected by said space detecting means.

16. An automatic grinder device as claimed in claim 15, wherein said space detecting means comprises an air micrometer.

17. An automatic grinder device as claimed in claim 1, wherein said control means includes means for leveling all tubes supported by said tube holder means by operation of said rotation means.

* * * * *